United States Patent [19]

Parker

[11] 4,122,222

[45] Oct. 24, 1978

[54] LAMINATE AND METHOD FOR DRYWALL HOLES AND JOINTS

[76] Inventor: Robert Franklin Parker, Rte. 5, Box 350, Wilmington, N.C. 28401

[21] Appl. No.: 784,327

[22] Filed: Apr. 4, 1977

[51] Int. Cl.[2] ..... B32B 13/04

[52] U.S. Cl. ..... 428/66; 52/514; 156/71; 156/94; 156/154; 428/60; 428/61; 428/63; 428/80; 428/134; 428/137; 428/156; 428/157; 428/172; 428/192

[58] Field of Search ..... 428/70, 77, 78, 80, 428/60, 61, 172, 189, 192, 194, 201, 211, 130, 134, 136, 137, 81, 177, 63, 66, 157, 76; 156/71, 94, 252, 258, 243, 139, 154; 52/514, 744

[56] References Cited

U.S. PATENT DOCUMENTS

| | | | |
|---|---|---|---|
| 1,357,350 | 11/1920 | Schumacher | 428/156 |
| 3,576,091 | 4/1971 | Shull, Jr. et al. | 52/746 |
| 3,874,505 | 4/1975 | Nirarchi et al. | 52/514 |
| 4,024,684 | 5/1977 | Holmgren | 52/514 |
| 4,042,739 | 8/1977 | Emal et al. | 428/156 |

FOREIGN PATENT DOCUMENTS

| | | | |
|---|---|---|---|
| 84,586 | 1958 | Denmark | 428/63 |
| 429,084 | 5/1935 | United Kingdom | 428/70 |

*Primary Examiner*—Stanley S. Silverman
*Attorney, Agent, or Firm*—B. B. Olive

[57] ABSTRACT

Disclosed is a method and a preformed laminate useful in various forms for repairing holes and covering joints in drywall. The laminate comprises a sheet material backing having an overlay of plaster joint compound, or the like. The overlay has an outwardly tapered thickness. The laminate may be in circular, strip, or other form. The backing material is secured over the hole or joint, as the case may be, and a small amount of drywall joint compound is added around the perimeter to blend the patch into the wall surface.

10 Claims, 16 Drawing Figures

LAMINATE AND METHOD FOR DRYWALL HOLES AND JOINTS

BACKGROUND OF THE INVENTION

1. Field of the Invention

The invention relates to a preformed laminate and method for patching holes and covering holes in drywall construction.

2. Description of the Prior Art

Drywall, also referred to as Sheetrock, provides a relatively inexpensive and desirable wall surface in many residential and commercial buildings. Drywall is, however, subject to having holes or indentations made therein during construction or later in use when struck by certain objects, for example, corners of furniture. The traditional approach to repairing such holes was first to fill the hole with a backing such as newspaper, rags, wire mesh, or the like, and then to overlay the backing with a patching compound. This method has proven undesirable because of the difficulty in maintaining the backing material in place. Even in those instances where a repair is completed, the repaired area remains a weak spot in the wall. Also, considerable time and finishing work is required.

It has been proposed to repair damaged drywall by circumscribing the damaged part with a uniform cutout, e.g. rectangular, inserting a cutout piece of wallboard of similar dimensions as the hole and holding this patch insert in place by suitable cement or by means of various spring-loaded or other devices which act on the inner surface of the opposing wall. Such repair devices require not only an opposing wall located behind the damaged wall but also frequently require a number of mechanical parts which must be carefully secured in the proper location. U.S. Pat. Nos. 3,690,084 and 3,936,988 are illustrative of such devices.

Also, it has been known to insert a folding patch of larger dimension than the hole to be prepared and then cementing or holding this folding patch in place while the repair is completed. U.S. Pat. No. 3,874,505 illustrates this form of repair.

In new construction work, finishing of wallboard joints has required numerous trips and hours of work by the drywall mechanic to build up the laminar cover of compound-paper-compound and to achieve a desired finish which could be painted, wallpapered, et cetera, and hide all indications of a joint. Also, various forms of joint tape have been employed to cover the abutting wallboard edges. U.S. Pat. Nos. 2,181,530 and 3,066,450 illustrate such tapes.

In all examples of prior art drywall finishing or patch kits, finishing or patch procedures, joint covering procedures, and the like, known to the applicant, considerable time has been required to build up the final laminar structure and the job normally requires that the drywall mechanic make repeated visits to the job to add or sand the joint compound to make it suitable for final painting or other wall treatment. The prior art has been primarily directed toward means and procedures for filling the hole or joint and not to providing preformed exposed surface material so as to eliminate this part of the job and to improve this aspect of the overall job. So far as is known, the prior art has not taught the concept of providing a preformed laminate which can be quickly installed, can be finished in a single operation suitable for final wall treatment, i.e., painting or the like, and in which the laminate itself provides a preformed rigid, thin laminar layer of the finishing compound that would otherwise have to be hand-troweled and finished over the hole or joint as is customary in prior art procedures.

SUMMARY OF THE INVENTION

The laminate product and method of the present invention may be made in circular, strip, or other geometric configurations, and may be provided when desired with holes to match receptacle holes or may be formed to meet particular abutting joint conditions such as in corners of a room, or the like. The laminate comprises a backing member of relatively thin sheet material over which is secured a body portion of plaster, or the like. The body portion is tapered from a relatively thick central area to a thin edge which terminates within the margin of the backing member.

In a preferred manner of using the laminate of the invention in a repair operation, a block of drywall is cut from a sheet or scrap piece so that the block is of larger dimension than the damaged hole area, the block is placed over the hole area, a pencil mark is drawn around the block and an oversize hole is cut around the regular hole in the drywall conforming to the shape of the block of drywall. A backing strip is secured behind the hole and the block or insert made from the drywall material is secured to the backing strip in the cut out hole. The insert provides a relatively strong surface over which the circular laminate is glued in place. Spackling or another similar joint compound is spread around the edges of what is now a cover patch and is smoothed to blend into the drywall surface in a single finishing operation.

In a finishing joint operation, contact glue or joint compound is spread around the surrounding crack to be covered by the preformed laminate in strip form. The area is dried to a tacky condition and the preformed laminate strip is put in place over the surface covered with tacky cement. A light bed of joint compound is applied to outer peripheral edges of the laminate and smoothed to a taper. The cement is allowed to dry and the area is finish sanded along edges and is ready for painting, et cetera. Corners may also be covered by various embodiments.

DESCRIPTION OF THE PREFERRED EMBODIMENT

Figure 1:
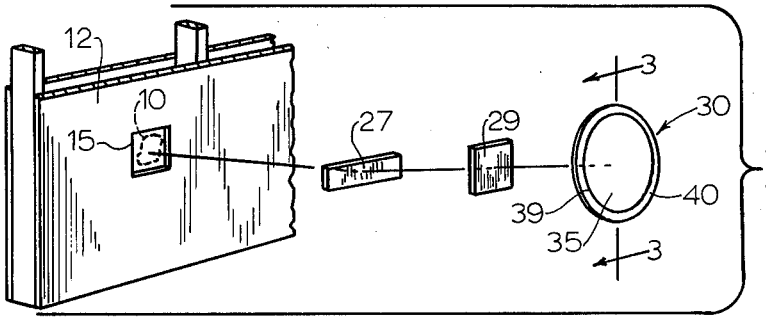
FIG. 1 is an exploded perspective view of a damaged drywall, block or insert, backing strip and a preformed circular laminar cover patch of the present invention illustrating the embodiment used for repair of damaged areas.
Figure 2:
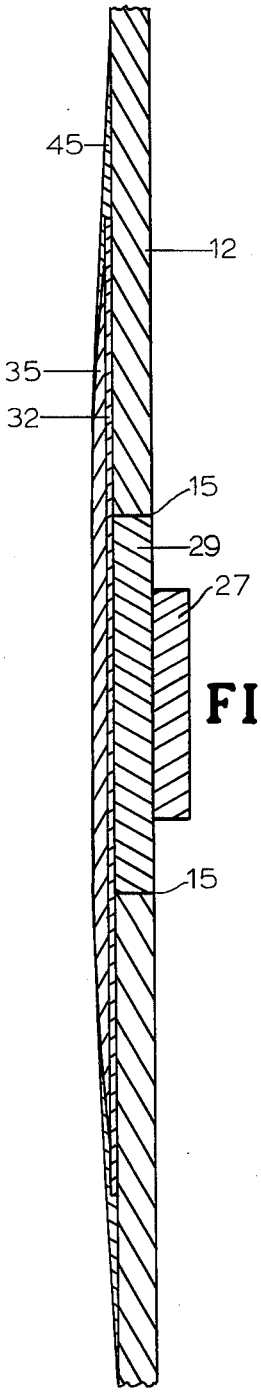
FIG. 2 is a section view taken through the completely patched drywall.

Referring to the drawings and in particular to FIGS. 1–5 which illustrate the first embodiment of the invention, the drywall cover/patch is used as a repair means and the method of applying it will be described. An irregular-shaped hole 10 (shown in dashed lines in FIG. 1) may be formed in drywall 12 by an accident, e.g., being bumped by furniture, children, pets, et cetera. As a first step in practicing the invention, a square block 29 of drywall material is cut from a sheet or scrap piece of drywall material so that block 29 is larger in length and width than hole 10. Block 29 is placed over hole 10 and the outline of block 29 is traced around hole 10. Next, a hole 15, similar in shape and size to block 29, is cut from drywall 12 thereby removing irregular-shaped hole 10. Next, a backing strip 27 made from a strip of wood, scrap drywall, or other suitable rigid material is secured in place behind hole 15 as shown in FIG. 2 by applying contact cement to strip 27. Backing strip 27 forms a backing for the insertion of block or insert 29. Insert 29 is slightly smaller than hole 15, since its outer dimensions were traced around hole 10, and when placed in hole 15 and secured to backing strip 27 by contact cement, substantially fills hole 15. Backing strip 27 and insert 29 may be secured in place by other like adhesive substances; or, if preferred, strip 27 could be secured in place by drywall screws (not shown) passing through drywall 12 and into strip 27.

After insert 29 is in place, preformed laminate or cover/patch 30 may be secured over insert 29 by means of contact cement, or the like. Cover/patch 30 includes a backing member 32 made from sheet material and a body portion 35 made from plaster, spackling material, gypsum material, joint compound, or the like. The backing sheet 32 has been cut in circular form, for example, from Prep-A-Tape type brand paper manufactured by United States Gypsum and as used for drywall construction. Other relatively thin, semi-stiff sheet material may be used. In this embodiment, a paper thickness of approximately 0.01 inch was employed. A range of backing sheet thickness and stiffness will be apparent to those skilled in the art and can be readily determined for any particular sheet material once the desired laminate invention characteristics are fully understood.

Figure 3:
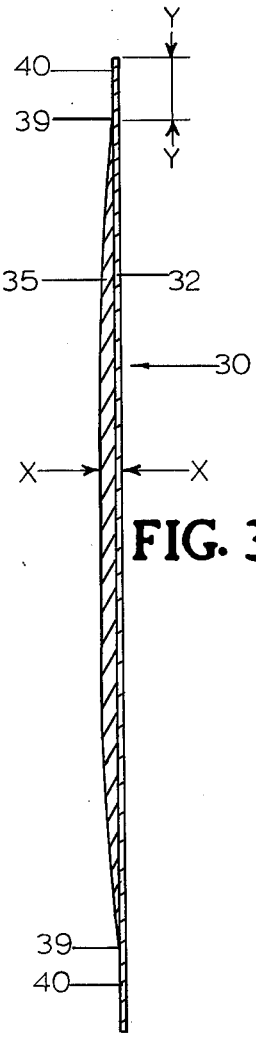
FIG. 3 is an enlarged view of the cover patch taken substantially along line 3—3 of FIG. 1.

As best shown in FIG. 3, the body portion 35 is the thickest at the center, e.g., 0.125 inch to 0.1875 inch, and tapers to a substantially thinner edge, e.g., 0.0825 inch, as at 39. Edge 39 is preferably formed so as to leave a substantially uniform marginal perimetric edge portion 39 of exposed sheet material of about 0.750 inch width as indicated at Y—Y. However, it has been found that when cover/patch 30 is actually manufactured, a thin layer or coat of the material forming the body portion 35 may sometimes cover portions of the exposed edge 40 and this does not disturb use of the invention in practice. The cover/patch 30 of the invention has been used in a wide variety of diameters. A preferred overall thickness X—X at the center has been approximately 0.1600 inches. Of practical value is the fact that it can be mass-produced and packaged for shipment without undue breakage in transit.

After cover/patch 30 is secured to the surface of drywall 12, a layer of plaster-like material 45, joint compound, or the like, is spread around the perimeter 40 and on edge 39 and is gently tapered onto the surface of drywall 12. Only one layer of material 45 is required whereas normal practice would require building up and finishing plural layers of the compound. After material 45 dries, it is smoothed in the usual way by sandpaper, or the like, until the body portion of cover/patch 30 blends smoothly into the surface of drywall 12. The patched area including the exposed surface of the preformed body portion 35 may then be painted to complete the operation. The center of the finished cover/patch will be raised slightly above the drywall surface, but it has been found that this is hardly noticeable. Only a small amount of finishing compound is required. Thus, it can dry quickly. The finished cover/patch presents a smooth, strong surface that will not easily crack even if it is struck. Normally, only a single sanding and final finishing operation is required which also saves time over prior art practices.

Figure 4:
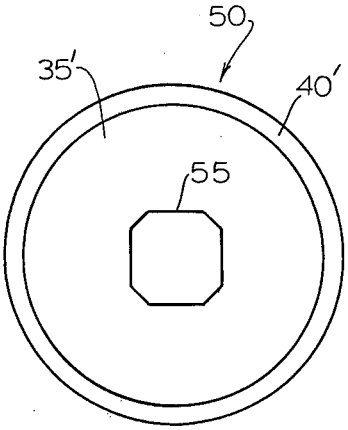
FIG. 4 illustrates a modified form of the first embodiment patch construction useful for repairing or relocating power box holes in drywall.

Another form of the first embodiment of the present invention is in cases where holes formed in drywall for purposes of installing power boxes, lightswitches, and the like, are initially formed in the wrong position. If the position is greatly in error, e.g. by over one foot, the above-described cover patch and method may be used to cover the mistake. Also, two of the cover patches 30 may be employed to cover large holes. If the mistake is only a matter of a few inches, even in cases where the correct location overlaps the mistaken location, cover/patch 50, shown in FIG. 4, is used.

Cover/patch 50 has a body portion 35' and a perimeter of exposed sheet material 40' and is identical in construction to cover/patch 30 except for having an opening 55 formed in the center of the cover/patch. Opening 55 is made to correspond to the size and shape of a power box hole which is to be formed in the drywall. Where the hole formed in the drywall is unintentionally mislocated by a small amount or is damaged, cover/patch 50 may be used in the following manner to correct the error. First, the user determines the correct location for the hole and forms an opening in the drywall at that location. The opening so formed may overlap the opening that was mislocated. This opening should approximate the shape of the desired hole but may have rough edges. Next, cover/patch 50 is adhered to the drywall by contact cement or other adhesive so that opening 55 is in the desired location. The remaining part of cover/patch 50 covers the mislocated hole so that the only opening in the patched wall is the correctly located opening 55. Cover/patches similar to cover/patch 50 may have different shaped openings depending upon the shape of the desired opening.

Figure 5:
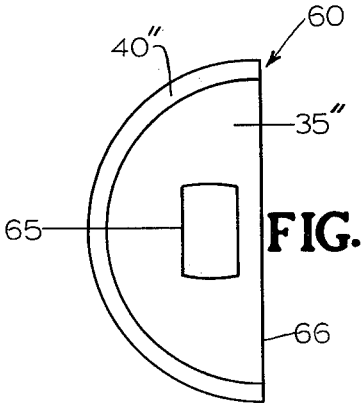
FIG. 5 depicts another modified form of the first embodiment patch construction useful for repairing or relocating a lightswitch hole near a wall edge or door.

Cover/patch 60, shown in the shape of a semicircle in FIG. 5, illustrates another form of the first embodiment of the present invention and is used in a manner similar to cover/patch 50. Cover/patch 60 includes an exposed perimeter of sheet material 40'' and a body portion 35''. An opening 65 is formed in cover/patch 60 for use as the wall opening for locating a lightswitch box. The straight edge 66 is utilized to abut a door molding strip or other wall edge located next to the light switch in an abutting linear edge relation.

It should be noted that the method of the first embodiment of the invention may be practiced without the use of a backing strip 27 or insert 29. In repairing relatively small wall openings, cover/patch 30 may be applied directly over the opening. It has been found that the inherent strength of the cover/patch will provide a strong patched wall surface, although not as strong as that obtained with the use of strip 27 and insert 29.

The term "thin" as hereafter used is intended to refer to a relative thickness applicable to the invention, as previously indicated, and which in each instance will be readily apparent to those skilled in the art who would be expected to keep the finished cover/patch as thin as practical. The range of thickness will thus vary with specific materials chosen for the cover patch of the invention and to some extent with the final thickness desired. Therefore, it is believed those skilled in the art can readily determine how thin and stiff the backing member 32, as well as how thin the body portion 35, needs to be for particular materials and finished appearance desired, to insure against breakage in shipment, and to give an overall aesthetic finish to the job. Representative thicknesses have already been set forth and have proven satisfactory in practice relating to the first embodiment of the present invention in the various forms.

Figure 6:
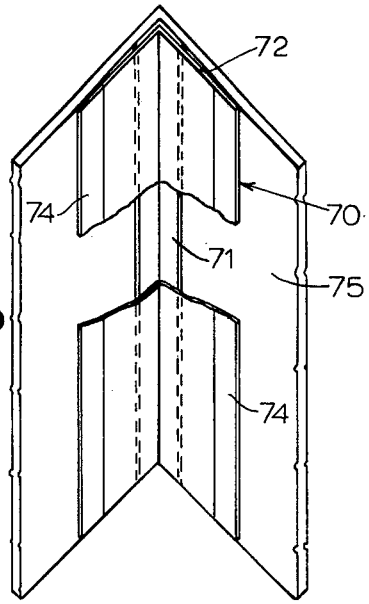
FIG. 6 is a fragmentary perspective view of a second embodiment of the present invention illustrating a preformed assembly of a metal backing strip and laminar strip according to the invention as used to finish an internal corner joint.
Figure 7:
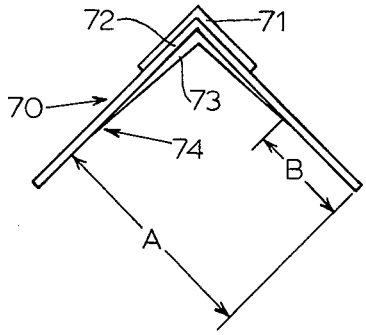
FIG. 7 is an enlarged plan view of the preformed, internal corner assembly of FIG. 6.

Turning now to FIGS. 6 and 7, a second embodiment of the present invention is illustrated as a prefabricated internal corner strip laminate member 70. Member 70 is intended to be integrally assembled prior to job site delivery and is composed of a metal right angle member 71, a "thin" right angle backing member 72 and a body portion 73 made from plaster, spackling material, gypsum material, joint compound, or the like. Body portion 73 is formed at right angles and is tapered from the thickest area at its center outward until it tapers off smoothly with edge 74. Members 71, 72 and 73 are integrally secured and preassembled by using contact cement or the like and when made integral as a laminate strip for job delivery are used to finish an internal joint made by merging drywalls and/or ceilings as in FIG. 6. Preferably, cover/patch member 70 is formed in lengths of 8 feet which is the height of an average room ceiling and is shipped and arrives at the job in this length. Higher ceilings may require longer lengths or piecing of the lengths.

While the embodiment illustrated in FIGS. 6 and 7 has a thin integral metal backing member, it is contemplated to laminate and transport to the job only the backing member and body portion as a preassembly. However, it should be noted that not only does the metal member add stability to the finished joint but it can be made economically of commercially available metal strip and enables factory fabrication and shipment with anticipation of little or no damage to the assembled member 70. In one form of the embodiment of FIGS. 6 and 7, dimension A was approximately 3 and ½ inches and dimension B was approximately 1 and ½ inches. In application, contact cement is applied to wall surface 75 in the area to be covered and laminate member 70 is set in place once the cement has become tacky. After a few minutes for setup or drying, a light bed or coat of the joint compound material is applied over the edges 74 so that member 70 appears as a finished corner once the compound has dried and is sanded.

Figure 8:
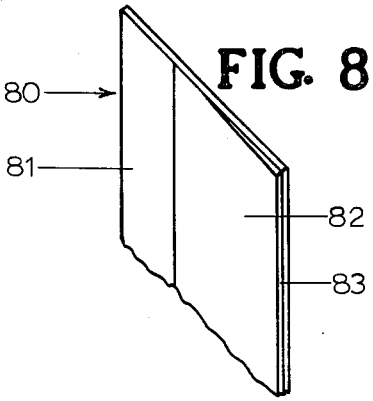
FIG. 8 is a fragmentary perspective view of a third embodiment of the present invention illustrating a strip laminate useful for external corners.
Figure 9:
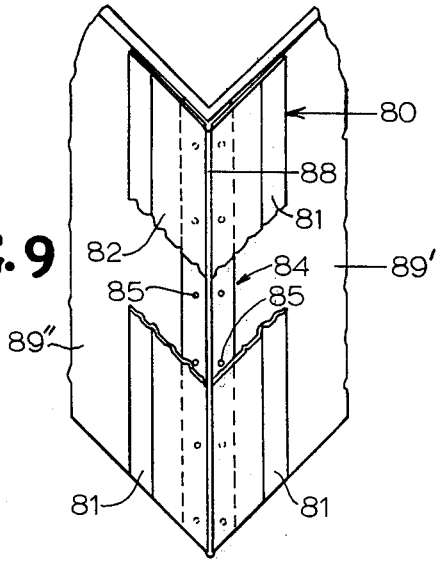
FIG. 9 is a fragmentary perspective view illustrating application of the third embodiment.
Figure 10:
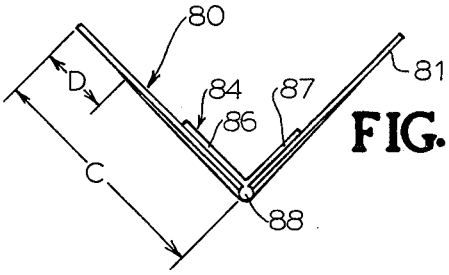
FIG. 10 is an enlarged plan view of a completed external corner construction.

Next, FIGS. 8, 9 and 10 illustrate a third embodiment of the present invention which is applicable for finishing of external corner areas. External corner cover/patch member 80 is formed as best seen in FIG. 8. Member 80 is a prefabricated unit comprised of a thin, flat backing member 81 and a body portion 82 made from one of the previously discussed materials. Cover/patch member 80 is prefabricated in eight foot lengths preferably since standard ceiling height is eight foot. Body portion 82 is integrally secured to backing member 81 and is tapered from its thickest end back to a point where it blends in with backing member 81. Also, the thickest end 83 of portion 82 is adapted to butt against a conventional metal right angle corner strip 84 which is conventionally secured to the external drywall external joint by nails or screws 85 before two of the strip members 80 are secured thereto. Right angle strip 84 is composed of outer wing portions 86, 87 through which nails 85 pass and an integral rounded bead 88 which, when member 84 is installed, acts as a protective means from damage due to bumping from various means. In assembly on the job, member 84 is nailed to the previously installed drywall sections 89', 89''. A contact cement is then applied to the outer surfaces of wing portions 86, 87 and over sufficiently additional area to receive a pair of members 80 as seen in FIG. 9.

A cover/patch member 80 is placed on each tacky cement surface so that edge 83 is abutting bead 88 (See FIG. 10) and provides a smooth appearance. Such an operation will, as mentioned, require use of a pair of members 80 to finish an external corner. Once the assembly has set up or dried, a light bed or coat of joint compound is applied to the outer edge 81 of each member 80 and smoothed so that a finished surface is achieved once the edge area is sanded. Dimension C in one embodiment was 3 and ½ inches and dimension D was one and one-half inches as illustrated in FIG. 10.

Figure 11:
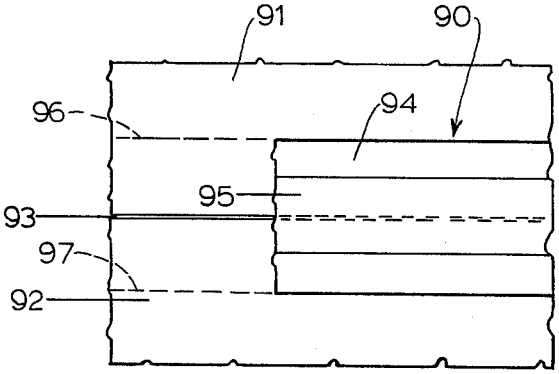
FIG. 11 is a fragmentary plan view of a section of a drywall formed by Sheetrock with the abutting edges running horizontally and with a fourth embodiment of the laminate of the invention covering the joint between the sections.
Figure 12:
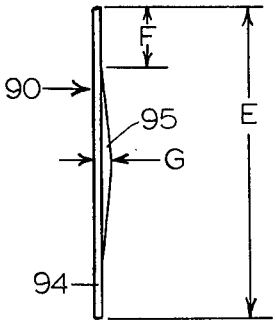
FIG. 12 is an enlarged side elevation view of the laminate of FIG. 11.
Figure 13:
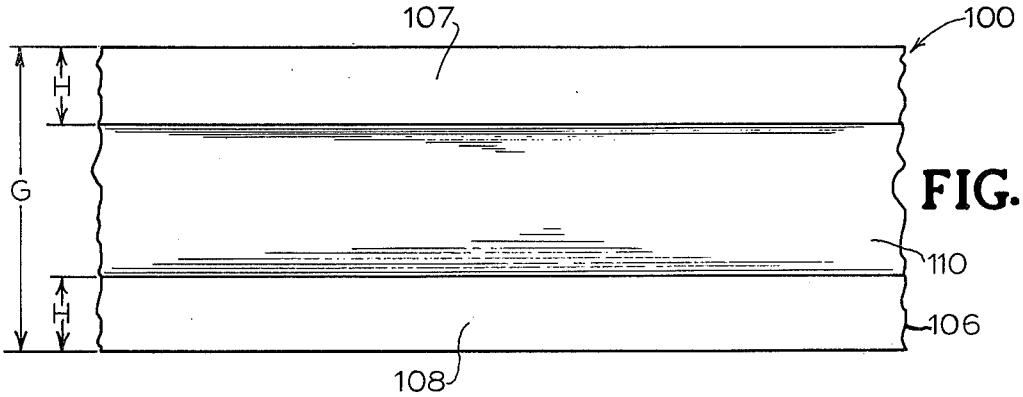
FIG. 13 is a plan view of a variation of the laminate of the fourth embodiment useful where a paper surface finish is desired over the plaster-like material finish.
Figure 14:
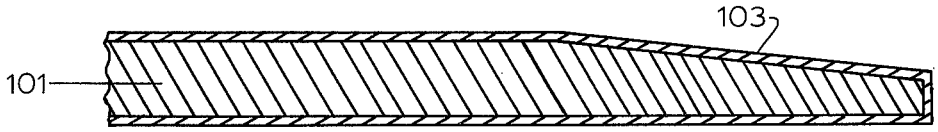
FIG. 14 is an enlarged, fragmentary, elevation section view of a conventional Sheetrock panel edge which is tapered along its edge.

Referring next to FIGS. 11 and 12 and a description thereof, a fourth embodiment of the present invention is encompassed within laminate member 90. Member 90 is designed for application where a pair of drywall boards 91, 92 are brought together in a wall and these boards 91, 92 may be oriented either horizontally, as illustrated, or vertically. When a pair of boards are abutted, a small crack is normally left at the point of abutment of the wallboards 91, 92. In order to provide a smooth finish, crack 93 must be covered and finished. Laminate member 90 is composed of a flat, thin, backing member 94 and a body unit 95. Laminate 90, in this embodiment, has been made with a width E of approximately ten inches, a width F of approximately 2 and ½ inches and a thickness G of approximately 0.125 inch at its thickest point. Member 90 is preformed so that body portion 95 and backing member 94 form an integral laminate and, after delivery to the job, member 90 is secured to drywall boards 91, 92. In order to achieve proper alignment of member 90, dashed guidelines 96, 97 are printed or otherwise impressed on wallboards 91, 92 so as to be equidistant from the respective edges forming crack 93. Securing is achieved by applying a contact cement to the area over which laminate member 90 is to be adhered. Once the contact cement is tacky, member 90 is placed over crack 93 and is aligned along lines 96, 97. After set-up of the cement, a light bed or coat of joint compound material is applied to the edges 94 of member 90 so that it is made to blend in with the remainder of the wall. Once this has dried, finish sanding of the edges provides a smooth, unnoticeable joint. Member 90 of this embodiment, as with the other embodiments, could, of course, be made in any desired length.

Referring lastly to FIGS. 13 through 16 and a description thereof, a variation of the fourth embodiment is illustrated in laminate member 100. Member 100 is designed for application where a pair of drywall boards 101, 102 having tapered edges 103, 104 are brought together in a wall and these boards 101, 102 may on the job be oriented either horizontally, as illustrated, or vertically. As in the previous arrangement, a pair of abutted wallboards 101, 102 leaves a small crack 105 at the point of abutment. However, in the case where wallboards 101, 102 are manufactured with a tapered edge, as at 103, 104, there is also a depressed area at the point of abutment. In this situation, laminate 100 is of particular advantage.

Laminate 100 has a thin backing member 106 formed of drywall type paper, or the like, and which generally conforms to the depressed area. Edge portions 107, 108 extend beyond the depressed area and generally lie flat against the face of wallboards 101, 102. Body portion 109 is made from plaster, spackling material, gypsum material, joint compound, or the like. A thin face sheet 110 formed of drywall type paper, or the like, is placed over body portion 109 but terminates inwardly of edge portions 107, 108 of backing member 106. The outer surface of face sheet 110 is intended to be suitable for painting or other on-the-job wall treatment. Members 106, 109 and 110 are intended to be integrally secured and preassembled as *s* strip unit in off-site manufacture for job delivery to be used to finish an abutment joint of the type having tapered edges forming a depressed area as previously described. In one application, width G was approximately 10 inches and width H was approximately 2 and ½ inches. Laminate 100 is preferably made and shipped in lengths of eight feet. Longer and shorter lengths are contemplated commensurate with specific application, shipping, packaging, delivery and storage considerations.

Figure 15:
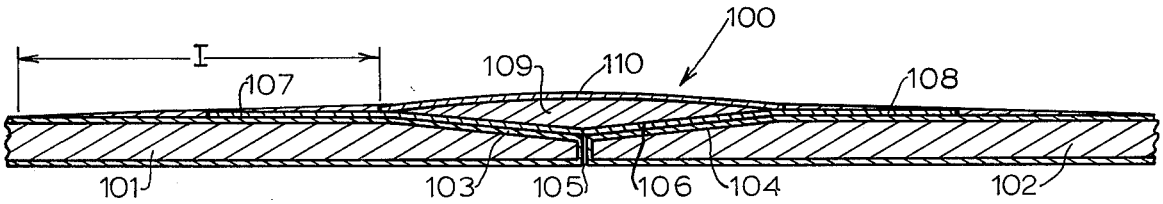
FIG. 15 is a fragmentary, elevation section view of a pair of abutting Sheetrock panels with the laminate of FIG. 13 secured in place as it would appear in use.
Figure 16:
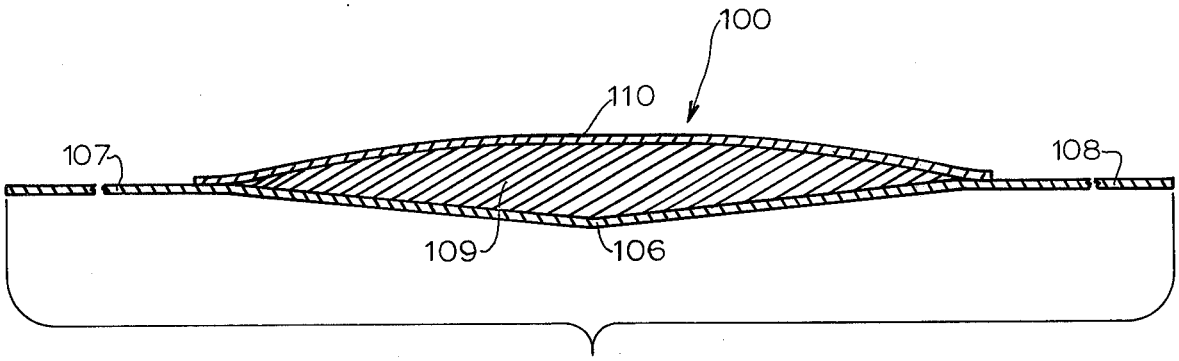
FIG. 16 is an enlarged, elevation section view of the FIG. 13 laminate.

Securing of laminate 100 at the job site is achieved by applying a contact cement, or the like, to the area over which laminate member 100 is to be adhered. Once the contact cement is tacky, member 100 is placed over crack 105 and the depressed area. As in the FIG. 11 arrangement, in order to achieve proper alignment of member 100, dashed guidelines can be pre-printed, embossed or otherwise formed on the surface of wallboards 101, 102 to guide application of the cement material at the job. After member 100 is adhered by the tacky material, a light bed or coat of joint compound material is applied to the edge portions 107, 108 of member 100 so that it is made to blend in with the remainder of the wall. This bed or coat need only extend from the outer edges of face sheet 110 to a point where it blends in with the outer surfaces of the respective wallboards forming the joint. The central outer area of member 100 does not require compound material because the outer surface of face sheet 110 provides a suitable finished surface. Width I is illustrative of the area which is covered by compound material as indicated in FIG. 15. Once this area has dried, finish sanding of widths I on both sides of the joint will complete the job and make it ready for painting or other wall treatment.

As with the other embodiments, use of preformed laminate 100 will substantially reduce the on-job time required since a large portion of the exposed area surrounding the joint or crack will not require application of any finishing compound. That is, since the outer exposed area of face sheet 110 is selected to have a suitable surface for receiving paint or whatever final surface treatment is desired, this area requires no finish coating on the job which saves in both time and expense.

A comparative description of the steps and time involved in covering, finishing, or patching a drywall joint conventionally and with the laminate product of the present invention will now be given.

Steps and Times — Conventional Method

1. Fill and cover crack with wet cement, normally a joint compound.
2. Tape over wet cement.
3. Dry for 24 hours, plus or minus, depending on the weather, available heat, etc.
4. Apply a heavy bed of cement over entire tape surface and well beyond edges.
5. Allow another 24 hours, plus or minus, to dry.
6. Apply light bed or coat of cement over surface of the heavy bed.
7. Allow to dry 24 hours, plus or minus.
8. Sand entire outer cemented area to desired finish.

Steps and Times — Method of Present Invention

1. Apply contact glue or joint compound over area surrounding crack, joint, ect., to be covered by prefabricated laminate member of the present invention.
2. Allow 10 minutes, plus or minus, depending on the weather, available heat, etc., for glue or compound to dry to a "tacky" condition.
3. Apply laminate member over surface having tacky cement.
4. Apply light bed of joint compound to the outer peripheral edges of laminate member and smooth to taper with drywall surface.
5. Dry cemented, tapered edges 2 hours, plus or minus.
6. Finish sand outer taper perihperal edges only.

As seen in the conventional method, approximately three days and several trips to the site are required as compared to what might be expected to be one day and one trip by the method and apparatus of the present invention. The majority of joint compound which eventually covers a joint or hole, as the case may be, will have been formed to a desired thickness and surface finish in the factory as part of the manufacturing operation in the prefabricated laminate system of the invention. Therefore, these surface areas will normally not require any, or the most nominal, finish sanding at the job site. In contrast with the conventional method, all of the covering compound over a joint or hole, as the case may be, is actually applied at the job site and therefore the entire surface of the joint or patch requires a finish sanding treatment. Those skilled in the art will also appreciate that any of the laminate embodiments could be trimmed or modified to accommodate intersecting joints, e.g. vertical-horizontal or two horizontal and one vertical joint as in an intersecting ceiling corner.

Those skilled in the art will also appreciate that the plaster-like material used in the body portion of the laminate product of the invention may be made from plaster itself or any of the plaster-like materials previously mentioned or any equivalent plaster-like materials having the desired characteristics set forth in the description.

What is claimed is:

1. A preformed laminate structure for finishing or repairing operations on previously installed drywalls comprising a single backing member made from thin sheet material shaped to cover a selected area of previously installed drywall to be finished or repaired and a body portion made from a thin layer of rigidified plaster-like material adhered on one side to a front face of said backing member and having an opposite uncovered side providing a surface for receipt of a finishing compound thereon, said body portion having its greatest thickness in the inner portion thereof and with said thickness tapering toward at least one edge portion thereof to a minimum thickness with at least some of the minimum thickness portion thereof spaced from an uncovered edge portion of said sheet material to provide a flat surface on such uncovered edge portion of sheet material for receipt of finishing compound to blend with the adjoining tapered body portion to hide said edge portion and its edge in the finished work.

2. A laminate structure as claimed in claim 1 wherein said structure is circular in form and said inner body portion tapers from the center thereof toward the circumference of the structure leaving a marginal circumferential edge portion of exposed sheet material of substantially uniform width.

3. A structure as claimed in claim 1 including an electrical outlet shaped opening formed therein and through said body portion.

4. A structure as claimed in claim 1 having selected aligned linear edge portions of said backing member and body portion formed and adapted to rest against a mating linear edge in the building construction receiving said structure.

5. A structure as claimed in claim 3 having selected aligned linear edge portions of said backing member and body portion formed and adapted to rest against a mating linear edge in the building construction receiving said structure.

6. A structure as claimed in claim 1 wherein said structure is formed as a right angular member of sufficient length to cover the area desired to be finished or repaired, said right angular structure having said body portion tapering outwardly from the apex of said right angle structure leaving an uncovered marginal edge.

7. A structure as claimed in claim 6 including a right angle metal reinforcing member secured to the outer back face thereof.

8. A structure as claimed in claim 1 wherein said backing member is rectangular in form and said body portion maximum thickness coincides substantially with the central axis of said backing member, said body portion having a rectangular form with the outer peripheral lengthwise running edges of said body portion being spaced uniformly inwardly from the lengthwise running edges of said backing member.

9. A preformed laminate structure for finishing or repairing operations on previously installed drywalls comprising·

(a) a backing member made from thin sheet material and having an area shaped to cover the area to be finished or repaired;

(b) a body portion made from a thin layer of rigidified plaster-like material adhered on one side to a front face of said backing member and having an inner portion of greatest thickness and with said greatest thickness tapering toward and terminating at a predetermined distance from outer uncovered flat edge portions of said backing member; and (c) a facing member made from thin sheet material and shaped to cover the surface of said body portion opposite said backing member, said facing member being adhered to said body portion on one side and having the opposite side uncovered to provide in conjunction with said uncovered edge portions of said backing member adjoining respective covered tapered and uncovered flat surfaces for receipt of a finishing compound to blend with said tapered body portion and hide said edge portions and the edges thereof in the finished work.

10. A laminate structure as claimed in claim 9 in strip form and wherein the linear edges of said body portion and facing member terminate at a uniform distance from the linear edges of said backing member.

* * * * *